US005968615A

United States Patent [19]

Schlappa

[11] Patent Number: 5,968,615

[45] Date of Patent: Oct. 19, 1999

[54] SEAL FOR CONSTRUCTION ELEMENT

[75] Inventor: Alfred Schlappa, Wesseling, Germany

[73] Assignee: Norton Performance Plastics S.A., Chaineux, Belgium

[21] Appl. No.: 08/642,616

[22] Filed: May 3, 1996

[30] Foreign Application Priority Data

May 3, 1995 [FR] France ..... 9505289

[51] Int. Cl.[6] ..... B29D 5/02

[52] U.S. Cl. ..... 428/34.1; 428/192; 428/220; 49/475.1; 49/479.1; 52/788; 52/786.1; 52/786.13; 52/786.11

[58] Field of Search ..... 428/34.1, 192, 428/220; 49/475.1, 479.1; 52/788, 786.1, 786.13, 786.11

[56] References Cited

U.S. PATENT DOCUMENTS

| | | | |
|---|---|---|---|
| 4,764,539 | 8/1988 | Ladang | 106/122 |
| 4,806,162 | 2/1989 | Ladang | 106/18.13 |
| 4,961,989 | 10/1990 | Grimwood | 428/229 |
| 5,171,629 | 12/1992 | Heidel et al. | 428/285 |
| 5,496,598 | 3/1996 | Delisle et al. | 428/34.1 |

FOREIGN PATENT DOCUMENTS

| | | |
|---|---|---|
| 0 240 248 | 10/1987 | European Pat. Off. . |
| 0 568 227 | 11/1993 | European Pat. Off. . |

*Primary Examiner*—Jose' G. Dees
*Assistant Examiner*—Michael A. Williamson
*Attorney, Agent, or Firm*—Oblon, Spivak, McClelland, Maier & Neustadt, P.C.

[57] ABSTRACT

The subject of the invention is a seal of flexible/compressible polymer and a surface coating made of a material which is incombustible and/or maintains its integrity at high temperature. The seals are useful in the construction of fire-resistant structures.

16 Claims, 2 Drawing Sheets

SEAL FOR CONSTRUCTION ELEMENT

BACKGROUND OF THE INVENTION

1. Field of the Invention

The present invention relates to seals for use as construction elements. Such seals can be used to intrinsically seal construction elements or to seal the assembly of a plurality of adjacent elements to form a wall.

The invention relates more particularly to seals for insulating wall panels, often called sandwich panels. These types of panels consist of metal walls delineating a cavity filled with a materially having good thermal and/or acoustic insulation properties such as a rigid foam of a polymer such as polyurethane. Such panels are advantageous in that they combine rigidity, lightness and high thermal/acoustic performance.

2. Discussion of the Background

Such panels are generally manufactured in the following manner. Continuous sheet-metal sheets are placed horizontally facing each other. These sheets are held at a given distance from each other while they move progressively on a conveyor belt. A highly reactive liquid mixture is then injected between these metal sheets. The liquid mixture expands in every direction in the form of a polymer foam. In order to prevent this foam from spilling out, the rims of the metal sheets are fitted with seals.

Once the foam has completely expanded, the metal sheets are cut transversely in order to obtain panels of the desired length. These panels can be subsequently joined together side-by-side to form walls, partitions, ceilings, etc. The seals, which initially served to contain the expansion of the foam within the cavity defined by the metal sheets, can also be used to seal at the grouting areas between adjacent panels. These seals protect the walls against moisture and prevent the creation of a thermal bridge when these panels are used outdoors.

In order to be effective, the seals must meet certain criteria. First, they must have good flexibility and good compressibility. Thus, seal; are themselves usually based on a polymer foam. The seals must also allow good "keying" and provide good adhesion to the panel cavity foam. These criteria are difficult to attain if the exterior of the seals are too smooth—which is often the case when the seals are made of closed-cell foam.

In order to remedy this, the industry has attempted two solutions—each with its; own drawbacks. First, the surface of the seal intended to be in contact with the panel foam may be roughened by abrading or slitting the foam of the seal along its thickness. Such methods are complicated and generate dust which subsequently has to be eliminated. Alternatively, the seal may also be rendered adhesive by incorporating an adhesive (for example of the acrylic type) into the foam. However, the presence of plasticizer in the seal may decrease its bondability to the interior foam. Furthermore, adhesives are combustible and may increase the flammability of the panels.

Typically, metal sheets retard the spread of fire. Unfortunately, their grouting areas are weak points. If the seals used to seal the grouting areas are flammable and they are directly exposed to flame, the fire may spread laterally, through the seals to the interior foam of the panels.

SUMMARY OF THE INVENTION

Accordingly, one object of the invention is to design seals for use as construction elements which are better than existing seals and which alleviate the aforementioned drawbacks. That is, the seals of the present invention have improved fire behavior without downgrading their ability to adhere to the elements on which they have been deposited.

The present inventors have found that these and other objects of the invention can be achieved using a seal based on a flexible/compressible polymer which is coated or made of a material which is incombustible and/or maintains its integrity at high temperature.

DETAILED DESCRIPTION OF THE PREFERRED EMBODIMENTS

Figure 1:
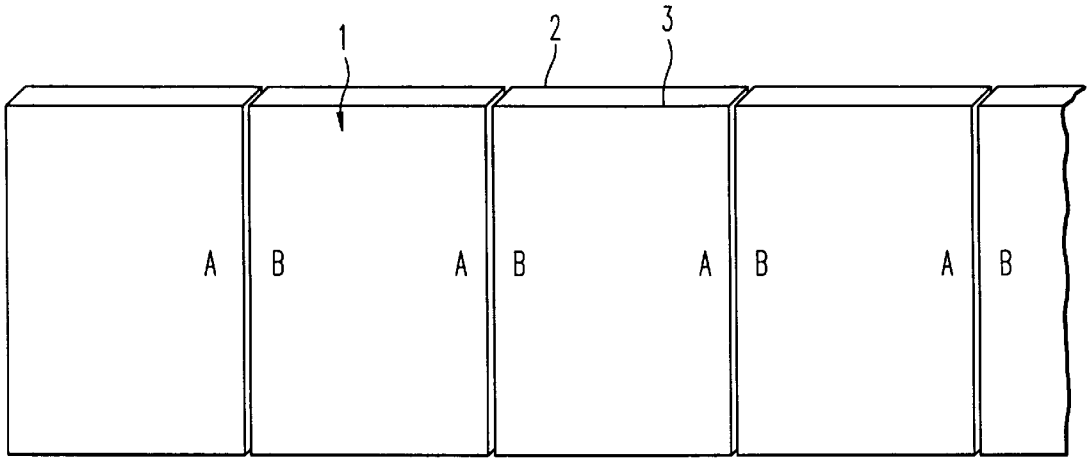
FIG. 1 is an assembly of insulating panels grouted according to the invention.

Suitable flexible/compressible polymer according to the invention comprises a polymer which is preferably a flexible foam of polyvinyl chloride (PVC), polyurethane (PUR), polyethylene (PE), terpolymer of polyethylene and polypropylene (EPDM), silicone, polypropylene (PP), rubber, styrene-butadiene-nitrile polymer (SBN) or neoprene or mixtures thereof.

These polymers can be treated and/or plasticized in order to obtain the desired flexibility. The foam texture has in effect the advantage of making the polymer highly compressible, something which is desirable when the seal is "jammed in" between two construction elements and must be compressed to a greater or lesser extent so as to fit into the gap separating them, taking into account the manufacturing tolerances of the said elements. It is in fact not unusual for such joints to have to exhibit a compressibility in their thickness of at least 30% to 50% and more.

The polymer may also be treated to improve its high-temperature and fire resistance, especially by incorporating into it a flame retardant additive. Suitable flame retardant additives include antimony oxide ($Sb_2O_3$), hydrated alumina or aluminum hydroxide, zinc borate, a brominated hydrocarbon or a chlorinated paraffin. Details concerning these compounds and their proportion with respect to the polymer may be found, for example, in U.S. Pat. No. 4,806,162, incorporated herein by reference.

The flexible/compressible polymer according to the invention can also comprise a polymer which meets the standards of Standard DIN 4102, such as class B1 polymers. Such a seal reinforces the fire-barrier effect of the surface coating.

The flexible/compressible polymer of the invention preferably is a polymer consisting of a foam of plasticized PVC to which one of the additives mentioned below has been added. Suitable plasticized PVC can be obtained from plastisols and foaming agents, for example those based on nitrogen-containing products such an sulphohydrazides or azodicarbonamides.

PVC plasticizers and plastisols are known and are discussed, for example, in the chapter devoted to PVC in the book "Plastics—Chemistry Applications" by Jean Bost, published by "Techniques and Documentation" in 1980. More details on the cellular PVCs may also be found in the book by Titow "PVC Technology", published by Elsevier in 1984, Chapter 25. Both chapters are incorporated herein by reference.

Plasticized PVC foam is preferred as it is highly compressible, has a surface weight of approximately 100 kg/m$^3$, and is easy to manufacture.

More generally, the flexible/compressible polymer of the present invention has a surface weight of approximately 80 to 150 kg/m$^3$. The polymer may form a foam which is of the closed-cell type or the open-cell type. If the polymer forms a foam which contains cells which are at least partly open, the foam may be impregnated with a moisture repellant. Any conventional moisture repellant can be used.

Surface coatings form an effective barrier to the spread of fire into the panel via the seal. This has two major advantages. By improving the fire behavior of the seal, the time before a panel catches fire after another has by a chimney effect at their grouting area is significantly retarded. Secondly, in construction elements of the hollow panel type containing an insulating product in the form of a polymer foam, this polymer was hitherto chosen so as to be "difficult to burn", according to the Standard DIN 4102, which corresponds to the class called B1. By virtue of the seals of the invention, which already considerably retard the time before the panel foams come into contact with the flames, it is possible to consider substituting these B1 classified foams with foams of slightly inferior flammability, especially foams simply termed "normally inflammable" according to the Standard DIN 4102, which corresponds to the class called B2. This substitution, although resulting in no decrease in the fire resistance of this type of panel, does result in quite significant savings in terms of the cost of raw materials. B2 foams are markedly less expensive than B1 foams. Overall, the cost of the additional surface coating of the seal is less than the cost of the B1 foams.

Moreover, a simple surface coating, which is by definition relatively thin, can further increase the anti-fire performance of the seal and consequently that of the construction elements employing this type of seal.

Suitable surface coatings of the present invention include glass, ceramic, metal, carbon, graphite or aramid. Preferably, these materials are used in fibrous form. The fibrous material may be woven or nonwoven (but agglomerated using a binder).

This fibrous material i, preferably composed of yarns comprised of individual filaments, especially when they are based on glass and obtained by mechanical drawing under a bushing. These filaments suitably have a diameter of between 5 and 12 micrometers, preferably between 7 and 9 micrometers. Tens of them are then combined together, with or without twisting, to become yarns having a linear weight advantageously of between 10 and 150 tex (1 tex corresponding to 1 g/1000 m of yarn), preferably 22 or 68 tex.

Fibrous materials are preferred because they enable a surface coating to be manufactured which has a certain surface rugosity, greatly facilitating the "keying" of the seal to the construction element and, more particularly in the case of an element in the form of an insulating panel having a polymer foam, the "keying" of the seal to the expanded foam. This makes it. unnecessary to use an adhesive on the surface coating. This is particularly desirable as adhesives are expensive and often are difficult to handle at high temperature. A fibrous material also has the advantage, especially in the case of a woven fabric, of being able to conform easily to any joint surface including a plane, curve or angle.

In a preferred embodiment of the invention, the flexible/compressible polymer is coated with a surface coating based on a woven fabric or web of glass fibers, which is made of a material which is both highly resistant to temperatures on the order of 500° C. and which has flexibility and slight surface rugosity.

Suitable surface coatings have a thickness of between 50 and 250 micrometers, especially approximately 100 to 200 micrometers. This range of thicknesses is sufficient to slow the spread of fire.

Likewise, it is preferable to choose a surface coating having a surface weight of between 50 g/m$^2$ and 300 g/m$^2$, preferably 100 to 200 g/m$^2$. This surface weight corresponds to a coating sufficiently dense to serve as a fire-spread barrier. The surface coating may then be applied to the polymer once it has been extruded. The coating can be applied using a device of the roll-coater type.

An adhesive can be used to facilitate the bonding between the foam and its coating. Any conventional adhesive may be used.

When the polymer is foam-based, the polymer may also be manufactured in the form of a continuous web, by passage through an oven at a suitable temperature and pressure, on a support which preferably consists of the surface coating itself lying on a conveyor. Once the foam has completely expanded, the formed web may be cut up in order to obtain a seal with the desired size and width.

The seal according to the invention may have extremely varied shape. Usually, it is in the form of a continuous tape whose cross-section has been sized. The cross-section may especially have the shape of a quadrilateral such as a square, rectangle, trapezium or parallelogram. Alternatively, the cross-section may be round or oval.

The thickness and surface weight of the surface coating,an be varied to ensure that this coating covers several of the faces of the seal instead of just one face, especially the side faces of the seal, or its entire exterior surface.

The dimensions of the seal may be varied considerably according to the construction requirements. For example, in the case of seals having rectangular cross-sections, thicknesses of, for example, 3 to 20 mm and widths matching the dimensions of the panels to be grouted, for example from 10 to 100 mm.

Various modes of manufacture exist for giving the seal the desired shape, especially the desired shape of the polymer which forms the major component thereof. As this polymer is preferably foam based, the desired shape may be obtained directly by extrusion techniques.

For this type of process, the foam is manufactured and combined with the surface coating in a single step, the foam "keying" into the coating without the need for an adhesive.

The seal according to the invention may have a first surface coating comprising fibrous material on the portion of the surface intended to adhere to the panel—so as to facilitate the keying of this seal—and a second surface coating on at least part of the exterior surface. The second coating may be a continuous film, especially a metal film. In fact, as this second coating is not intended to have to adhere to a foam of an insulating panel, it may have a smooth surface without causing any trouble.

It is therefore possible to choose to cover the entire exterior surface of the seal with one or more surface coatings according to the invention. In this way, an optimum effect of slowing down the spread of fire by the seal is guaranteed.

As mentioned previously, the use of seals according to the invention is particularly recommended for sealing construction panels comprising essentially metal walls which delineate a cavity filled with thermal and/or acoustic insulation material of the rigid polymer foam type, thus improving the fire resistance thereof. It is preferred to place the seals of the invention in at least part of the area of "jointing" of the walls of such a panel, sometimes called a sandwich panel.

EXAMPLE

The details and characteristics of the invention will emerge from an embodiment explained in detail below, this embodiment being non-limiting and illustrated using the appended figures.

The panels 1 shown schematically in FIG. 1 are arranged in a vertical plane so as to form an exterior wall of a building. Each panel has roughly the shape of a parallelepiped with a thickness of approximately 60 to 100 mm, a width of approximately 2 to 3 m and a length which may range especially from 3 to 16 m or more. They are assembled in a vertical plane so as to form a building wall (and are mechanically fixed using a metal framework, not shown). Each panel 2, 3 consists of a planar or profiled sheet metal wall, especially made of steel and with a thickness of 0.6 to 0.9 mm, delineating a cavity 4 filled with rigid-polyurethane foam 5 which is classified as B1 or B2 in terms of fire resistance according to the Standard DIN 4102.

Figure 2A:
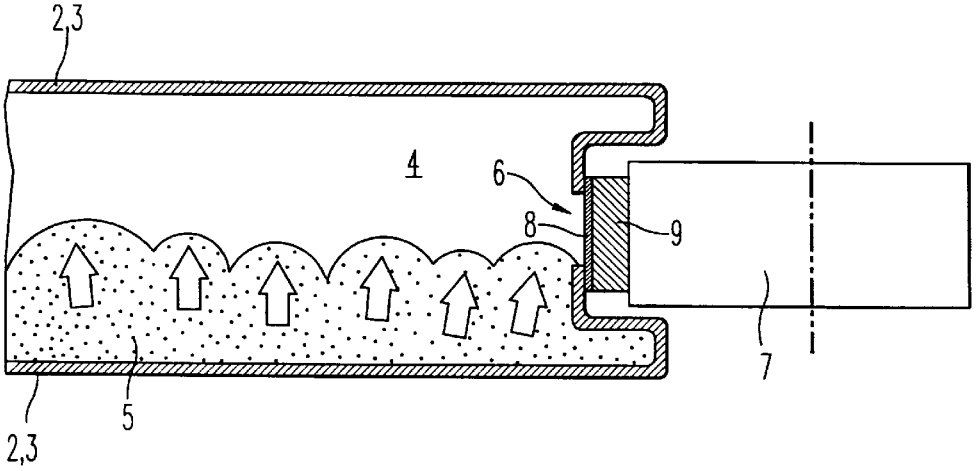
FIG. 2 shows the manufacture of an insulating panel with a seal according to the invention.
Figure 2B:
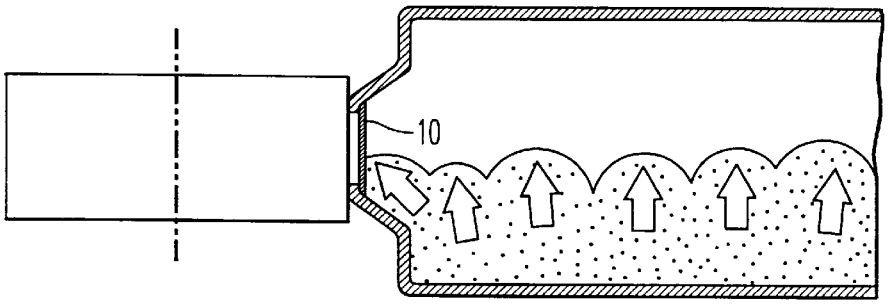

FIG. 2 details the manufacture of such panels. The opposed lateral edges of the panels are identified respectively by the letter A and the letter B, Sheet metal sheets 2, 3 are arranged one on top of the other and maintained at a distance d as they move on a conveyor with a jointing area 6 between the two sheets. The reactive liquid, based on suitable polyurethane precursors and foaming agents, is continuously injected between the two sheets 2, 3. As the expansion of the foam starts, pressure rollers 7, on the side A, press the seal 8, 9 as it is progressively unreeled. The seal 8, 9 is then arranged so that its surface coating 8 lies against the jointing area 6. The pressure of the pressure rollers 7 is maintained over a length which is sufficient for the foam 5 in the panel 1 to adhere to the surface coating 8 and thus fixes the seal 8, 9 in position.

On the side B, two variants are possible. Either the same operation as on side A is performed, by placing the same type of seal 8, 9, or, as shown, a metal film 10 (such as aluminum) which has been crimped in the jointing area.

The sides A and B have profiled rims so as to define a female part (side A) and a male part (side B) which enable the panels subsequently to be assembled easily by fitting them one into another.

Once the foam 5 has completely expanded, cutting tools (not shown) cut the sheets transversely to their axis of progressive movement on the conveyor so as to obtain the finished panels with the desired length.

Let us now turn in more detail to the structure and manufacture of the seal. The seal 8, 9 has a rectangular cross-section (45 mm in width and 6 mm in thickness) and is provided on one of its faces with a woven glass fabric 8,100 micrometers in thickness, composed of glass yarns having a linear weight of 22 tex, consisting of the combination of individual filaments 7 micrometers in diameter, and having a surface weight of 107 g/m$^2$.

Good results are also obtained using slightly thicker woven fabric, for example approximately 180 micrometers in thickness, and/or slightly more dense, for example from 200 to 210 g/m$^2$, which are obtained especially from yarns having a slightly greater linear weight, for example approximately 70 tex or more. This seal is based on a foam 9 of plasticized PVC and having a degree of compressibility in its thickness of at least 50%. Containing anti-fire additives, this foam 9 is classified as B1 according to the Standard DIN 4102.

The seal is manufactured in the following manner. Onto the woven glass fabric .3 having the predefined characteristics and deposited on a conveyor is poured a reactive liquid based on plastisols and on ad hoc blowing agents, and then the assemble is passed through an oven at a suitable temperature and pressure, the foam 9 of plasticized PVC then progressively expands on the woven glass fabric 8, adhering strongly to it.

This foam furthermore contains anti-fire additives, comprising antimony trioxide at approximately 1.25% by weight, zinc borate at approximately 1.25% and chlorinated paraffin at 4% by weight with respect to the weight of PVC, the paraffin being especially chosen from the range of products sold under the name of CERECLOR by Imperial Chemicals Industries plc. Once it has cooled, the foam web obtained is cut by cutting tools, of the circular-saw type, and arranged in rows above it, in the direction of its axis of progressive movement on the conveyor, so as to obtain a plurality of tapes having the desired rectangular cross-section, the tapes being subsequently reeled up before use, as described previously. This method of manufacture is highly advantageous in terms of efficiency and manufacturing cost. However, the seal can also be extruded directly to the desired size. Extruded seals are of interest insofar as they enable seals 8, 9 to be obtained with more elaborate cross-sections, especially circular ones.

Figure 3:
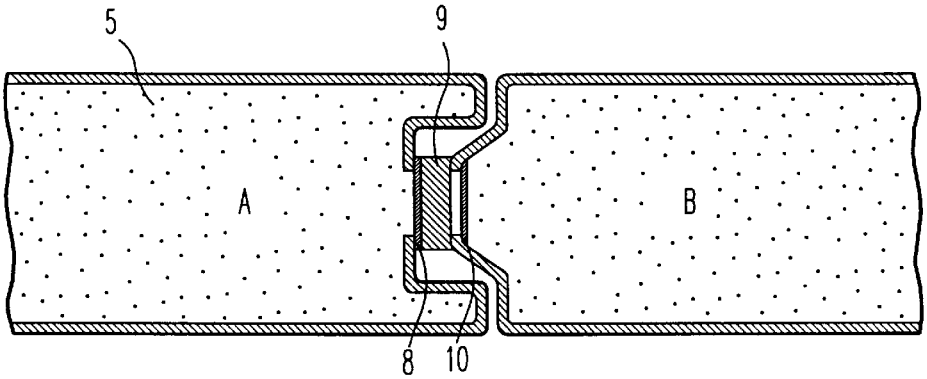
FIG. 3 is a cross-section on a horizontal plane of the grouting area between two panels assembled according to FIG. 1.

FIG. 3 shows, in cross-section, the grouting area between two panels 1 as assembled in FIG. 1; the seal 8, 9 is compressed by at least 30% in its thickness, the side B of the first panel fitting into the side A of the second panel with a certain "play". Consequently, in the event of a fire, the seals 8, 9 are directly exposed to the flames, hence the importance of improving their fire behavior in order to prevent the fire from spreading from the foam 5 in one panel 1 to the foam in an adjacent panel via the seals 8, 9, which are the only "weak points" in these structures since the sheet metal sheets 2, 3 of the panels 1 are otherwise highly efficient in retarding the progress of the fire.

Surprisingly, the woven glass fabric 8 of the seals 8, 9 according to the invention has proved to be excellent in slowing down the progress of fire, and its texture has proved to be highly advantageous since it furthermore improves the adhesion of the foam 5 in the panel 1 to the foam 9 of the seal without requiring treatment of the foam of the seal and/or the addition of adhesive.

The fact that the foam of the seals is itself treated with anti-fire additives reinforces the fire resistance of the seals according to the invention.

Having now fully described the invention, it will be apparent to one of ordinary skill in the art that many changes and modifications can be made thereto without departing from the spirit or scope of the invention as set forth herein.

This application is based on application No. 95/05289 filed in France on May 3, 1995. The full text of this foreign application is incorporated herein by reference.

What is claimed as new and is desired to be secured by Letters Patent of the United States is:

1. A seal comprising a flexible/compressible polymer foam and a surface coating comprising a material which is incombustible or maintains its integrity at temperatures on the order of 500° C., wherein the surface coating comprises a woven or nonwoven fibrous material, and wherein the fibrous material comprises a yarn having a linear weight of between 10 and 150 tex.

2. The seal of claim 1, wherein said yarn comprises individual filaments having a diameter of between 5 and 12 micrometers.

3. A seal comprising a flexible/compressible polymer foam and a surface coating comprising a material which is incombustible or maintains its integrity at temperatures on the order of 500° C., wherein the surface coating comprises a woven or nonwoven fibrous material, and has a thickness of between 50 and 250 micrometers.

4. A seal comprising a flexible/compressible polymer foam and a surface coating comprising a material which is incombustible or maintains its integrity at temperatures on the order of 500° C., wherein the surface coating comprises a woven or nonwoven fibrous material, and has a surface weight of between 50 $g/m^2$ and 300 $g/m^2$.

5. A seal comprising a flexible/compressible polymer foam and a surface coating comprising a material which is incombustible or maintains its integrity at temperatures on the order of 500° C., wherein the surface coating comprises a woven or nonwoven fibrous material, and wherein said flexible/compressible polymer comprises a foam of polyvinyl chloride, polyurethane, polyethylene, terpolymer of polyethylene and polypropylene, silicone, polypropylene, rubber, styrene-butadiene-nitrile polymer or neoprene or mixtures thereof.

6. The seal of claim 5, wherein said flexible/compressible polymer has a surface weight of approximately 80 to 150 $kg/m^3$.

7. The seal of claim 5, wherein said flexible/compressible polymer comprises a closed-cell foam or a foam having cells which are at least partly open and impregnated with a moisture repellant.

8. A seal comprising a flexible/compressible polymer foam and a surface coating comprising a material which is incombustible or maintains its integrity at temperatures on the order of 500° C., wherein the surface coating comprises a woven or nonwoven fibrous material, and wherein said flexble/compressible polymer comprises a foam of plasticized polyvinyl chloride.

9. The seal of claim 8, wherein said flexible/compressible polymer comprises a foam of a plastisol or foaming agents based on a sulphohydrazide or an azodicarbonamide.

10. A seal comprising, a flexible/compressible polymer foam and a surface coating comprising a material which is incombustible or maintains its integrity at temperatures on the order of 500° C., wherein the surface coating comprises a woven or nonwoven fibrous material, and which is in the form of a tape having a cross-section which is quadrilateral.

11. A seal comprising a flexible/compressible polymer foam and a surface coating comprising a material which is incombustible or maintains its integrity at temperatures on the order of 500° C., wherein the surface coating comprises a woven or nonwoven fibrous material, and which comprises two or more surface coatings, and which has a first surface coating comprising a fibrous material on part of said polymer and a second surface coating comprising a continuous metal film on the remainder of said polymer.

12. A seal comprising a flexible/compressible polymer foam and a surface coating comprising a material which is incombustible or maintains its integrity at temperatures on the order of 500° C., wherein the surface coating comprises a woven or nonwoven fibrous material, and wherein the surface coating comprises glass.

13. A seal comprising a flexible/compressible polymer foam and a surface coating comprising a material which is incombustible or maintains its integrity at temperatures on the order of 500° C., wherein the surface coating comprises a woven or nonwoven fibrous material, and wherein the flexible/compressible polymer comprises polyvinyl chloride.

14. A construction panel which comprises parallel metal walls delineating a cavity with open edges, a thermal and/or acoustic insulation material of a rigid polymer foam type in said cavity and a seal comprising a flexible/compressible polymer foam and a surface coating comprising a material which is incombustible or maintains its integrity at temperatures on the order of 500° C., wherein the surface coating comprises a woven or nonwoven fibrous material on at least one edge.

15. A method comprising sealing a metal panel with a seal comprising a flexible/compressible polymer foam and a surface coating comprising a material which is incombustible or maintains its integrity at temperatures on the order of 500° C., wherein the surface coating comprises a woven or nonwoven fibrous material.

16. A method comprising sealing a plurality of panels with a seal comprising a flexible/compressible polymer foam and a surface coating comprising a material which is incombustible or maintains its integrity at temperatures on the order of 500° C., wherein the surface coating comprises a woven or nonwoven fibrous material.

* * * * *